US005864186A

United States Patent [19]

Kurtz et al.

[11] Patent Number: 5,864,186

[45] Date of Patent: Jan. 26, 1999

[54] SLIDE ACTUATED AUDIO VOLUME CONTROL ASSEMBLY

[75] Inventors: Kevin D. Kurtz, Ft. Wayne; Richard L. Black, Granger; John Zdanys, Jr., Elkhart, all of Ind.

[73] Assignee: CTS Corporation, Elkhart, Ind.

[21] Appl. No.: 45,078

[22] Filed: Mar. 20, 1998

[51] Int. Cl.[6] ..... H01H 15/06

[52] U.S. Cl. ..... 301/119; 200/252; 200/541; 200/547

[58] Field of Search ..... 307/112, 119; 200/531, 541, 547, 548, 291, 550, 252

[56] References Cited

U.S. PATENT DOCUMENTS

| | | | |
|---|---|---|---|
| 2,246,373 | 6/1941 | Lodge . | |
| 2,356,521 | 8/1944 | Kochner . | |
| 3,226,515 | 12/1965 | Concelman . | |
| 3,330,930 | 7/1967 | Hill et al. . | |
| 3,461,252 | 8/1969 | Vananzi . | |
| 3,462,564 | 8/1969 | Bedocs . | |
| 3,632,909 | 1/1972 | Rowley . | |
| 3,663,780 | 5/1972 | Golbeck . | |
| 3,739,126 | 6/1973 | Sahrbacker et al. . | |
| 3,781,866 | 12/1973 | Kilby . | |
| 3,787,653 | 1/1974 | Maher . | |
| 3,857,000 | 12/1974 | Boulanger . | |
| 3,857,008 | 12/1974 | Van Der Donk . | |
| 4,172,972 | 10/1979 | Sykora et al. . | |
| 4,186,288 | 1/1980 | Overton et al. . | |
| 4,204,104 | 5/1980 | Quigley . | |
| 4,307,268 | 12/1981 | Harper . | |
| 4,314,112 | 2/1982 | Mission et al. . | |
| 4,322,588 | 3/1982 | Chumley et al. | 200/548 |
| 4,341,935 | 7/1982 | Josemans . | |
| 4,491,703 | 1/1985 | Jaklic | 200/291 |
| 4,506,119 | 3/1985 | Tanabe . | |
| 4,599,496 | 7/1986 | Lecklider . | |
| 4,668,849 | 5/1987 | Sasaki et al. . | |
| 4,669,654 | 6/1987 | Levine et al. | 236/46 R |
| 4,710,600 | 12/1987 | Sasaki et al. . | |
| 4,716,409 | 12/1987 | Hart et al. | 340/825.22 |
| 4,737,602 | 4/1988 | Yamamoto . | |
| 5,043,540 | 8/1991 | Takano | 200/16 C |
| 5,191,971 | 3/1993 | Hakkarainen et al. . | |
| 5,544,274 | 8/1996 | Walker et al. | 200/252 |
| 5,587,886 | 12/1996 | Lan . | |
| 5,672,854 | 9/1997 | Nishio . | |

*Primary Examiner*—Albert W. Paladini
*Attorney, Agent, or Firm*—Michael W. Starkweather

[57] ABSTRACT

A volume control for in-wall building stereo systems. Specifically, there is a sliding switch coupled between a mounting bracket and a printed circuit board that has components mounted thereon including two multi-tap inductors or transformers. The in-wall mounted speaker volume control slide selector switch assembly. Specifically, the assembly has a sliding selector switch, for housing electrical components, having a shaft extending from the sliding selector switch, for sliding in a linear direction to control volume of the in-wall mounted speaker. Additionally, there is a transformer, for supplying power to the in-wall mounted speaker, having a plurality of transformer taps. Further, there is a printed circuit board, for electrically connecting and physically mounting the transformers and the sliding selector switch thereto. Also, there is a mounting bracket, for supporting the printed circuit board and the transformer and sliding selector switch. The mounting bracket has a slot, for receiving the shaft during linear actuation, and a mounting tab, for attaching the mounting bracket to the printed circuit board. Finally, there are a plurality of selector switch pin lead holes mounted in the printed circuit board for electrically and mechanically connecting pins from the transformer and sliding selector switch.

7 Claims, 3 Drawing Sheets

SLIDE ACTUATED AUDIO VOLUME CONTROL ASSEMBLY

BACKGROUND OF THE PREFERRED EMBODIMENT(S)

1. Field of the Preferred Embodiment(S)

This invention generally relates to volume controls for in-wall building stereo systems. Specifically, there is a sliding switch coupled between a mounting bracket and a printed circuit board that has components mounted thereon including two multi-tap inductors or transformers.

2. Description of the Related Art

Various devices are well known for controlling the volume of speakers located in walls of buildings. The controls are typically mounted behind a control panel or a multi-gang control panel, or individual stand along volume control switch.

Examples of patents related to the present invention are as follows, wherein each patent is herein incorporated by reference for related and supporting teachings:

U.S. Pat. No. 5,191,971, is a multi-position wall mountable control switch with tactile feedback linear actuator.

U.S. Pat. No. 4,710,600, is a detent mechanism for sliding electric parts.

U.S. Pat. No. 4,668,849, is a detent mechanism for sliding electric parts.

U.S. Pat. No. 4,491,703, is a detenting and contact registration system for a linear DIP switch.

U.S. Pat. No. 3,781,866, is a binary encoding switch.

U.S. Pat. No. 3,632,909, is a slide selector matrix keyboard switch assembly with improved contact structure.

U.S. Pat. No. 3,461,252 is a multiposition slide switch.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

PROBLEMS WITH THE PRIOR ART

There are several problems that exist with the prior art that are addressed by the preferred embodiment. One problem is that rotary selector switches are typically made zinc die cast material with a threaded bushing around a rotary actuated switch shaft. The die cast bushing is ridged enough to support the entire switching assembly. The switching assembly typically includes the switch, a printed circuit board, a terminal block, and two transformers that make up most all of the weight. The switching assembly is mounted to a control panel by placing the bushing through a stamped bracket and thereby placing a threaded nut therearound. The design of this assembly has prevented the introduction of other styles of switches, including linear slide switches. Therefore, there is a need for a switching assembly design that will allow the introduction of other switch styles, including linear switches.

Another problem was that there have not been any cost effect way of making a linear switch that would fit in a small foot print to accommodate the mounting of the assembly into a wall mounted unit.

This and other problems will be solved by the preferred embodiments of the invention. A review of the specification, drawings, and claims will more clearly teach a skilled artisan of other problems that are solved by the preferred embodiments.

SUMMARY OF THE PREFERRED EMBODIMENT(S)

It is a feature of the invention to provide a volume control for in-wall building stereo systems. Specifically, there is a sliding switch coupled between a mounting bracket and a printed circuit board that has components mounted thereon including two multi-tap inductors or transformers.

It is a feature of the invention to provide an in-wall mounted speaker volume control slide selector switch assembly. Specifically, the assembly has a sliding selector switch, for housing electrical components, having a shaft extending from the sliding selector switch, for sliding in a linear direction to control volume of the in-wall mounted speaker. Additionally, there is a transformer, for supplying power to the in-wall mounted speaker, having a plurality of transformer taps. Further, there is a printed circuit board, for electrically connecting and physically mounting the transformers and the sliding selector switch thereto. Also, there is a mounting bracket, for supporting the printed circuit board and the transformer and sliding selector switch. The mounting bracket has a slot, for receiving the shaft during linear actuation, and a mounting tab, for attaching the mounting bracket to the printed circuit board. Finally, there are a plurality of selector switch pin lead holes mounted in the printed circuit board for electrically and mechanically connecting pins from the transformer and sliding selector switch.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other features of the invention can best be understood by the following description of the accompanying drawings as follows.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DETAILED DESCRIPTION OF THE PREFERRED EMBODIMENT

Figure 1:
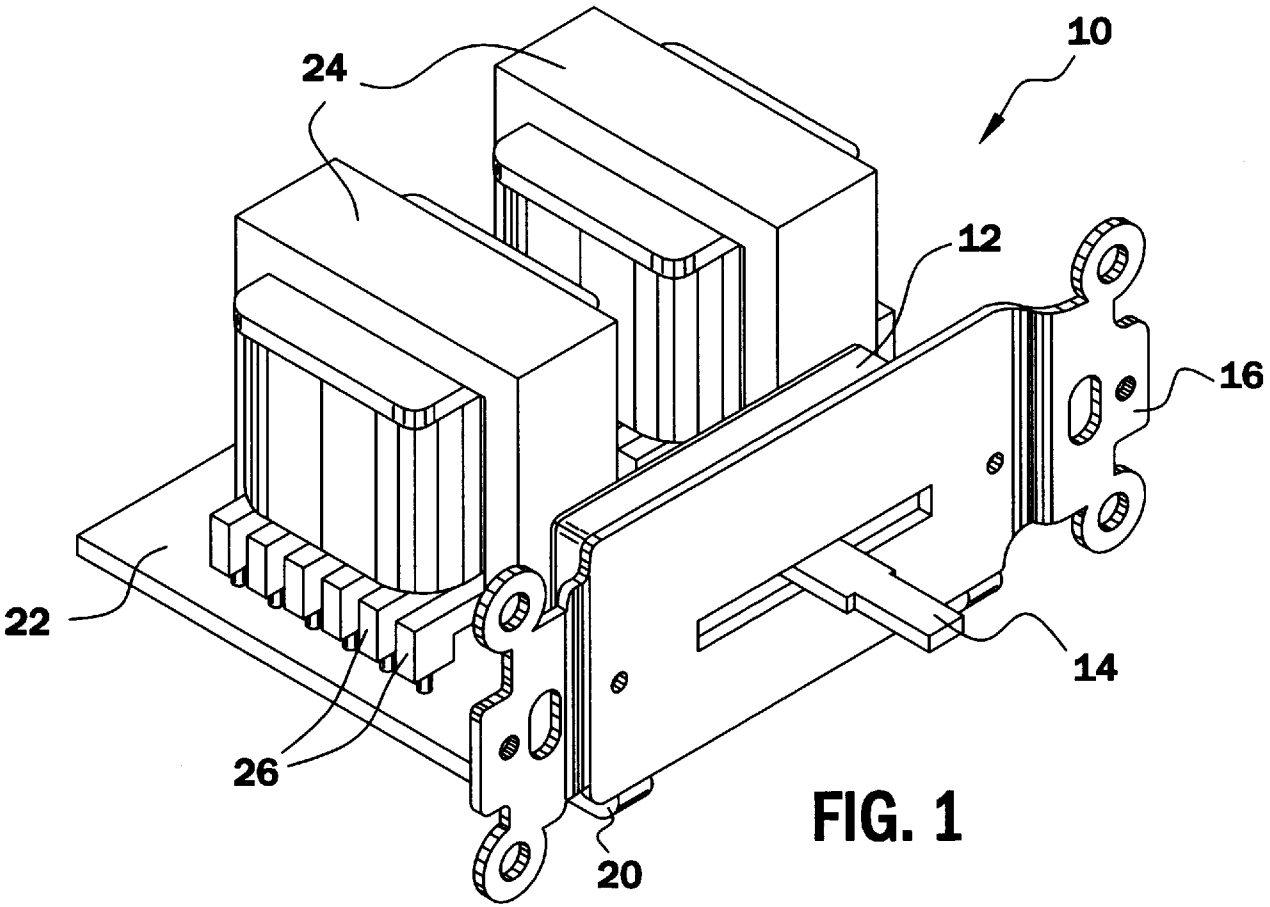
FIG. 1 is a perspective view of a volume control slide selector switch assembly.
Figure 2:
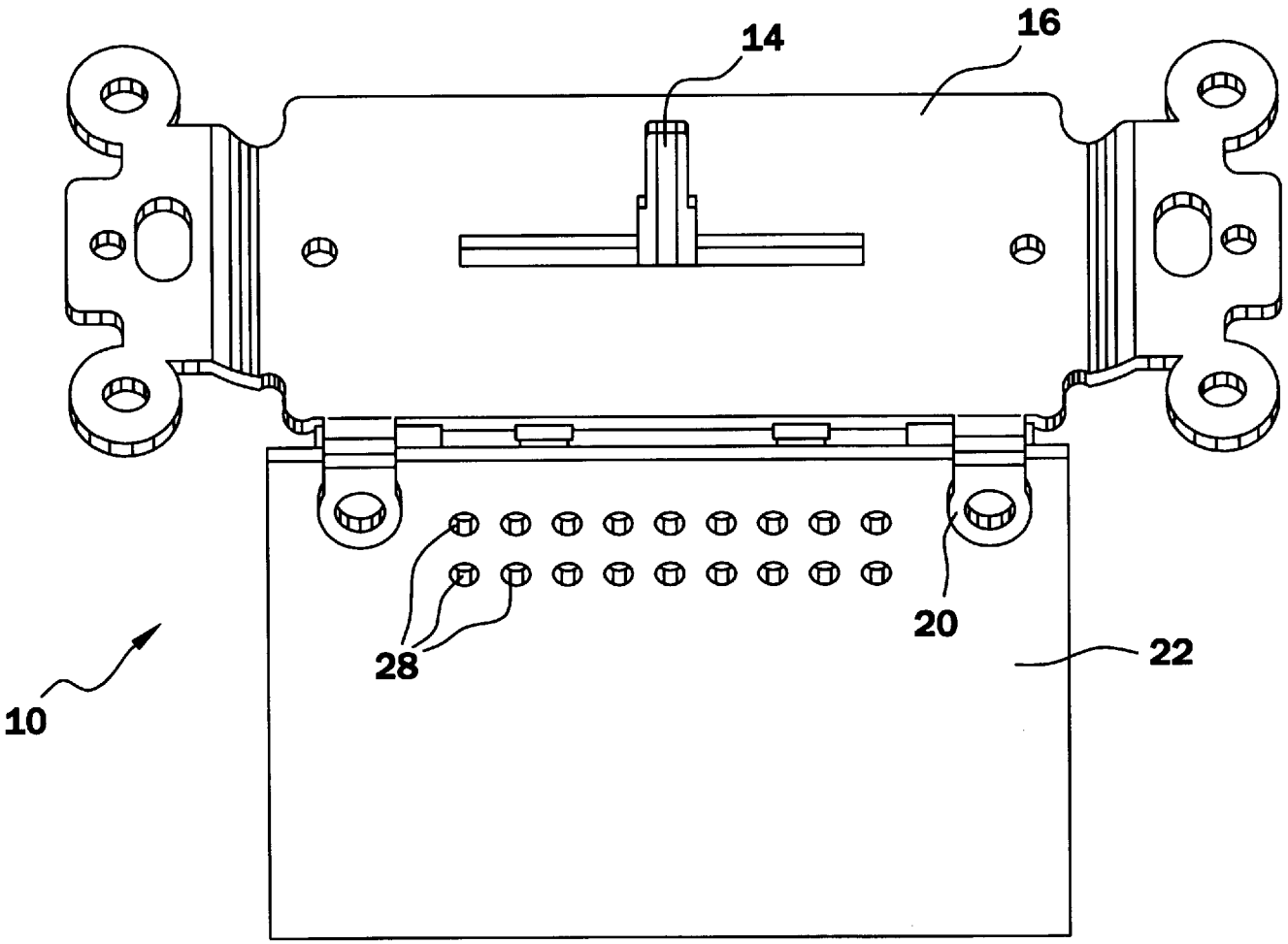
FIG. 2 is a tilted perspective bottom view of the preferred embodiment illustrated in FIG. 1.

Referring to both FIGS. 1 and 2, there are two perspective views of a volume control slide selector switch assembly 10.

In particular, there is a selector switch 12 for housing the sliding selector switch electrical and mechanical components (not shown), a sliding selector switch actuator shaft 14, a steel stamped mounting bracket 16 having a slide opening or slot 18, a mounting tab 20, a printed circuit board 22, transformers 24, transformer taps 26, and selector switch pin lead holes with pins (not shown) soldered thereon. The taps 26 are electrically connected to the slide selector switch 12 via traces (not shown) that are mounted on the printed circuit board 22.

REMARKS ABOUT THE PREFERRED EMBODIMENT

One of ordinary skill in the arts of in-wall speaker volume controls will realize many advantages from using the preferred embodiment. In particular, the whole assembly 10 has the major component of the weight supported by the bracket 16. However, unlike the prior art designs, the bracket is attached to the printed circuit board 22 for the purpose of physically supported by transformer weight and relieving the shaft from supporting the weight. It is noted that the tabs 20 are designed for attaching the printed circuit board 22, which supports the transformers 24, to the bracket 16. Where the bracket is then mounted to a control panel (not shown) by screws or other attachment means (not shown). Therefore, shaft 14 is now free to operate in most any style of operation, for example as illustrated by the sliding selector switch 12 and shaft 14, by providing more degrees of freedom than heretofore allowed.

A skilled artisan will realize that there are many types of slide selector switches that can accomplish the intended function of the preferred embodiment. For example, two single channel selector switches that are ganged or tied together and operated as a single slide switch could also provide the intended multi-channel.

Figure 3:
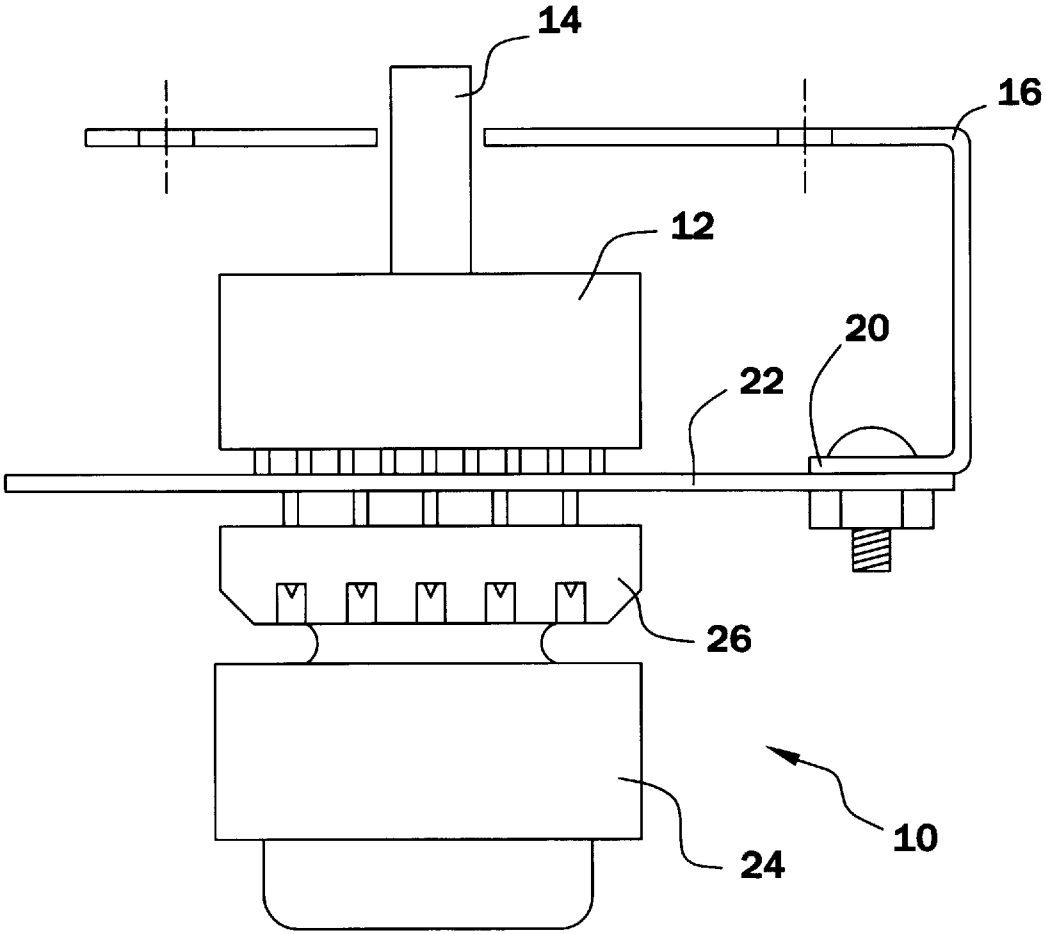
FIG. 3 is a sectional side view of another embodiment of the invention.

A skilled artisan also realizes that the overall positioning of the various components illustrated in FIGS. 1, 2 and 3 forms a small three dimensional foot print. This enables the placement of the assembly 10 into a typical in-wall mounting environment.

VARIATIONS OF THE PREFERRED EMBODIMENT(S)

One of ordinary skill in the art of making in-wall speaker volume controls will realize that there are many different ways of accomplishing the preferred embodiment. For example, even though the preferred embodiment illustrates the printed circuit board 22 as being perpendicular to the bracket 16 it is contemplated to have any arrangement just so that the bracket receives most of the weight of the transformers. In particular, as illustrated in FIG. 3, there is a sectional side view of a potential design that has the switch shaft 14 in line with the switch housing 12, the PCB 22, and the transformers 14.

Even though, the embodiment illustrates two tabs 20, any number will be sufficient just so the transformer weight is supported off of the switch shaft 14.

Although a steel stamped mounting bracket 16 is illustrated, the bracket 16 can be made of most any material and be in most any various shape.

It has been illustrated the use of two transformers 24 for the purpose of two channel voltage control or selection. However, it is contemplated that similar function can be accomplished through the use of multiple resistor pairs in place of the transformers or even capacitors. Thus, controlling the volume of a speaker by way of controlling the voltage supplied thereto.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by letters patent is:

1. An in-wall mounted speaker volume control slide selector switch assembly, comprising:

a) a sliding selector switch (12), for housing electrical components, having a shaft (14) extending from the sliding selector switch, for sliding in a linear direction to control volume of the in-wall mounted speaker;

b) a transformer (24), for supplying power to the in-wall mounted speaker, having a plurality of transformer taps (26);

c) a printed circuit board (22), for electrically connecting and physically mounting the transformers and the sliding selector switch thereto;

d) a mounting bracket (16), for supporting the printed circuit board and the transformer and sliding selector switch, having:

d1) a slot (18), for receiving the shaft during linear actuation; and d2) a mounting tab (20), for attaching the mounting bracket to the printed circuit board;

e) a plurality of selector switch pin lead holes mounted in the printed circuit board for electrically and mechanically connecting pins from the transformer and sliding selector switch.

2. An in-wall mounted speaker volume control slide selector switch assembly, comprising:

a) a sliding selector switch (12), for housing electrical components, having a shaft (14) extending from the sliding selector switch, for sliding in a linear direction to control volume of the in-wall mounted speaker;

b) volume control means, electrically coupled to the sliding selector switch, for controlling the volume of the in-wall mounted speaker volume;

c) a printed circuit board (22), for electrically connecting and physically mounting the transformers and the sliding selector switch thereto;

d) a weight supporting means, coupled to the printed circuit board, for supporting the weight of the transformers from affecting the shaft; and e) a plurality of selector switch pin lead holes mounted in the printed circuit board for electrically and mechanically connecting pins from the transformer and sliding selector switch.

3. The in-wall mounted speaker volume control slide selector switch assembly of claim 2, wherein the weight supporting means comprises a mounting bracket (16), for supporting the printed circuit board and the transformer and sliding selector switch, having: a slot (18), for receiving the shaft during linear actuation; and a mounting tab (20), for attaching the mounting bracket to the printed circuit board.

4. The in-wall mounted speaker volume control slide selector switch assembly of claim 3, wherein the printed circuit board has a major surface that is oriented perpendicular to a major surface of the mounting bracket.

5. The in-wall mounted speaker volume control slide selector switch assembly of claim 3, wherein the printed circuit board has a major surface that is oriented parallel to a major surface of the mounting bracket.

6. The in-wall mounted speaker volume control slide selector switch assembly of claim 2, wherein the volume control means comprises a transformer (24), for supplying power to the in-wall mounted speaker, having a plurality of transformer taps.

7. The in-wall mounted speaker volume control slide selector switch assembly of claim 2, wherein the volume control means comprises a series of resistors to vary the voltage supplied to the speakers.

* * * * *